US006171214B1

(12) United States Patent
Lundin

(10) Patent No.: US 6,171,214 B1
(45) Date of Patent: Jan. 9, 2001

(54) CHIN EXERCISE DEVICE

(76) Inventor: Christopher B. Lundin, 18 Oliver St., Suite 204, North Easton, MA (US) 02356

( * ) Notice: Under 35 U.S.C. 154(b), the term of this patent shall be extended for 0 days.

(21) Appl. No.: 09/231,242

(22) Filed: Jan. 15, 1999

(51) Int. Cl.[7] ..... A63B 23/00
(52) U.S. Cl. ..... 482/10; 482/121; 482/124
(58) Field of Search ..... 602/17, 8; 482/121, 482/904, 907, 10, 129, 124

(56) References Cited

U.S. PATENT DOCUMENTS

| | | | |
|---|---|---|---|
| 3,497,217 | * | 2/1970 | Feather . |
| 3,721,439 | | 3/1973 | Rudolph et al. . |
| 3,813,096 | | 5/1974 | Welch . |
| 4,066,259 | * | 1/1978 | Brenthan . |
| 4,280,696 | | 7/1981 | Ramon . |
| 4,460,171 | * | 7/1984 | Plyhm . |
| 4,744,556 | | 5/1988 | Shaffer . |
| 4,793,334 | * | 12/1988 | McGuiness et al. . |
| 4,909,502 | | 3/1990 | Beeuwkes, III et al. . |
| 5,035,420 | * | 7/1991 | Beeuwkes, III et al. . |
| 5,501,646 | | 3/1996 | Miller . |

* cited by examiner

*Primary Examiner*—Jerome Donnelly
(74) *Attorney, Agent, or Firm*—Norman F. Lehrer

(57) ABSTRACT

The chin exercise device in a first embodiment of the present invention includes an elongated handle having a top end, a bottom end, a front side, and a rear side; a pair of curved members extending outwardly from the top end of the handle; and an arm which is pivotally attached to the curved members. The arm has a foam pad for receiving a person's chin. Attached to the rear side of the elongated handle is a foam pad which is placed against a person's clavicle or chest when the device is used by a person to exercise. In order to use the device a person holds the handle and places the foam pad of the handle against his or her chest. The person then places his or her chin into or on the foam pad on the arm. The person moves his or her chin downwardly, toward his or her chest. The springs create resistance as the person brings his or her chin down, thereby exercising the muscles of the chin. The second embodiment of the present invention is similar to the first embodiment; however, the springs are replaced with flexible bands. The bands may be changed in order to increase or decrease the amount of resistance. In a third embodiment of the invention, the resistance provided in the device is created by a single flexible band. The amount of resistance may be varied by placing the band in various positions.

7 Claims, 5 Drawing Sheets

CHIN EXERCISE DEVICE

BACKGROUND OF THE INVENTION

The present invention is directed toward a chin exercise device and more particularly, toward a device which improves muscle tone in the chin and neck areas.

As people become older their bodies start to change. One typical sign of change is sagging and flabby skin in the chin and neck areas. Such a condition is the result of underlying muscles losing their tone due to aging and/or lack of proper exercise. The muscles elongate and droop or sag. This condition also causes wrinkles.

One way of controlling this condition is cosmetic surgery commonly known as a "face-lift." This procedure is effective in tightening facial skin. However, as a result of such tightening, the skin must support the underlying muscle. If this muscle lacks tone, it is lengthened and becomes droopy. Since the skin is not adapted to support the underlying muscles, this creates an even stronger tendency for the skin to droop. While such a method is a quick fix, it is temporary. That is, the process of drooping and wrinkling gradually starts again and the surgery must be repeated. Furthermore, this surgical procedure does not strengthen or tone muscles.

Exercise is one well known way which is effective in toning and strengthening muscles in the arms and legs. The same is also effective in strengthening the muscles of the chin and neck. Besides which, exercising provides long-term results, is inexpensive, simple, and healthier than cosmetic surgery.

Several devices are known which aid a person in exercising his or her chin and neck. One such device is disclosed in U.S. Pat. No. 3,497,217 to Feather which teaches an exercising device with a base plate which rests on a person's thorax or chest with a chin rest member space above the base plate. A hinge connects the base plate and chin rest member. Springs between the members resist compression when the person moves his or her head up and down, thereby exercising the muscles of the neck. This device, however, may not be stable and can slip from its location between the person's chest and chin. Furthermore, the compression forces cannot be easily adjusted.

SUMMARY OF THE INVENTION

The present invention is designed to overcome the deficiencies of the prior art described above and to provide an exercise device which isolates, tones, strengthens, and firms the muscles of the chin, neck, and face.

It is a further object of the invention to provide an exercise device which is portable, easy to use, and wherein the forces can be easily adjusted.

In accordance with the illustrative embodiments, demonstrating features and advantages of the present invention, there is provided an exercise device which, in a first embodiment, includes an elongated handle having a top end, a bottom end, a front side, and a rear side; a pair of curved members extending outwardly from the top end of the handle; and an arm which is pivotally attached to the curved members. The arm has means for receiving a person's chin which may be in the form of a foam pad. Attached to the rear side of the elongated handle are means for resting on a person's clavicle or chest. The resting means may include a foam pad which is placed against a person's clavicle or chest when the device is used by a person to exercise. In order to use the device, a person holds the handle and places the resting means against his or her chest. The person then places his or her chin into or on the foam pad on the arm. The person moves his or her chin downwardly, toward his or her chest. The springs create resistance as the person brings his or her chin down, thereby exercising the muscles of the chin. The second embodiment of the present invention is similar to the first embodiment; however, the springs are replaced with flexible bands. The bands may be changed in order to increase or decrease the resistance. In a third embodiment of the invention, the resistance provided in the device is created by a single flexible band. The amount of resistance may be varied by placing the band in various positions.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
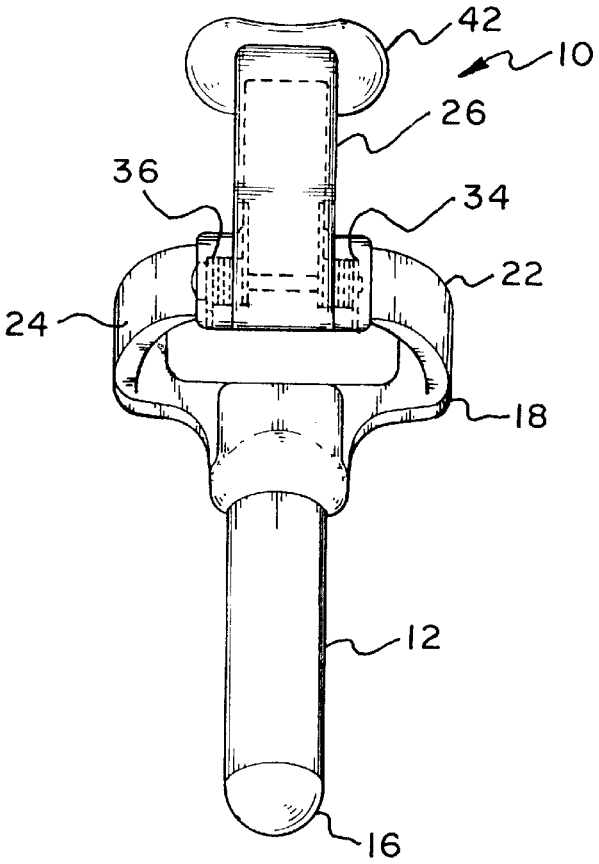
FIG. 1 is a front perspective view of a first embodiment of the present invention.

Referring now to the drawings in detail wherein like reference numerals have been used throughout the various figures to designate like elements, there is shown in FIG. 1 an exercise device constructed in accordance with the principles of the present invention and designated generally as 10.

Figure 2:
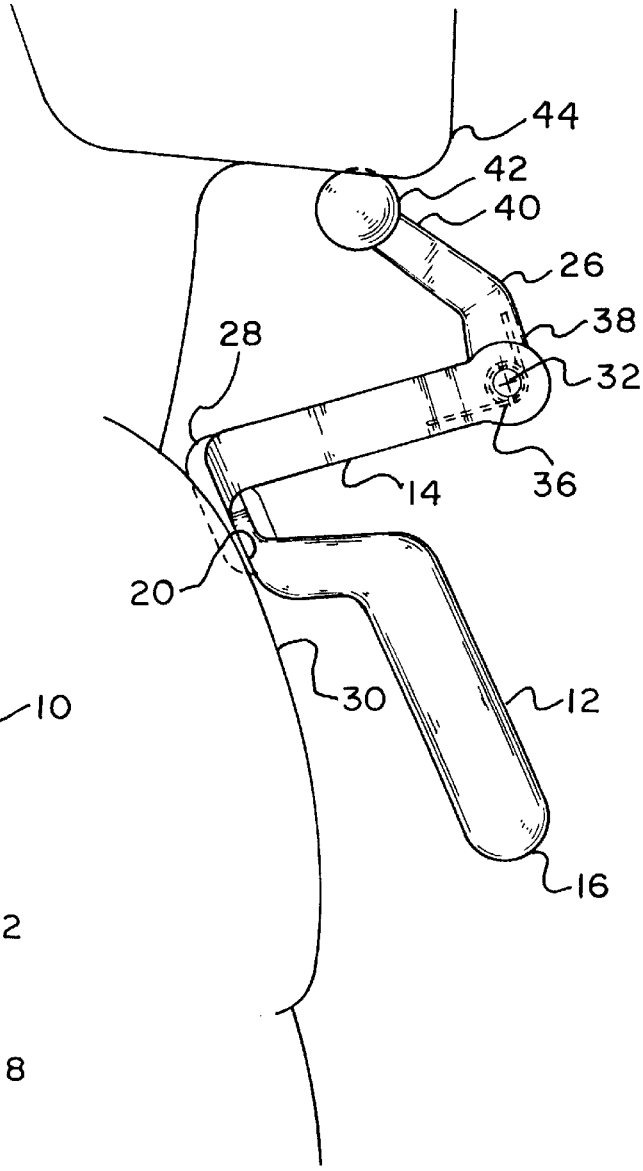
FIG. 2 is a schematic representation of a person using the first embodiment of the present invention.

The first embodiment of the chin exercise device 10 of the present invention is seen in FIGS. 1 and 2 and includes an elongated handle 12 having a top end or extension 14, a bottom end 16, a front side 18, and a rear side 20; a pair of curved members 22 and 24 extending outwardly from the top end 14 of the handle 12; and an arm 26 which is pivotally mounted to the curved members 22 and 24. Attached to the rear side 20 of the elongated handle 12 is means 28 for resting the upper portion of the handle on a person's clavicle or chest. (See FIG. 2.) The resting means 28 may include a foam pad which is placed against a person's clavicle or chest 30 when the device is used by a person to exercise.

Arm 26 is attached to curved members 22 and 24 by a pivot member 32, such as pin, and springs 34 and 36 at a first end 38 of the arm 26. Located at a second end 40 of the arm 26 is means 42 for receiving a person's chin. Means 42 includes a foam pad or the like into which a person places his or her chin 44 while exercising. The springs may be coil or helical springs. Also, multiple springs could be used. Likewise, a leaf spring may be used.

In order to use the device a person holds the handle 12 and places means 28 against his or her chest 30. The person then places his or her chin 44 into or on the foam pad 42 on the arm 26. (See FIG. 2.) The person moves his or her chin 44 downwardly, toward his or her chest 30. The springs 34 and 36 create resistance as the person brings his or her chin 44 down, thereby exercising the muscles of the chin.

Figure 4:
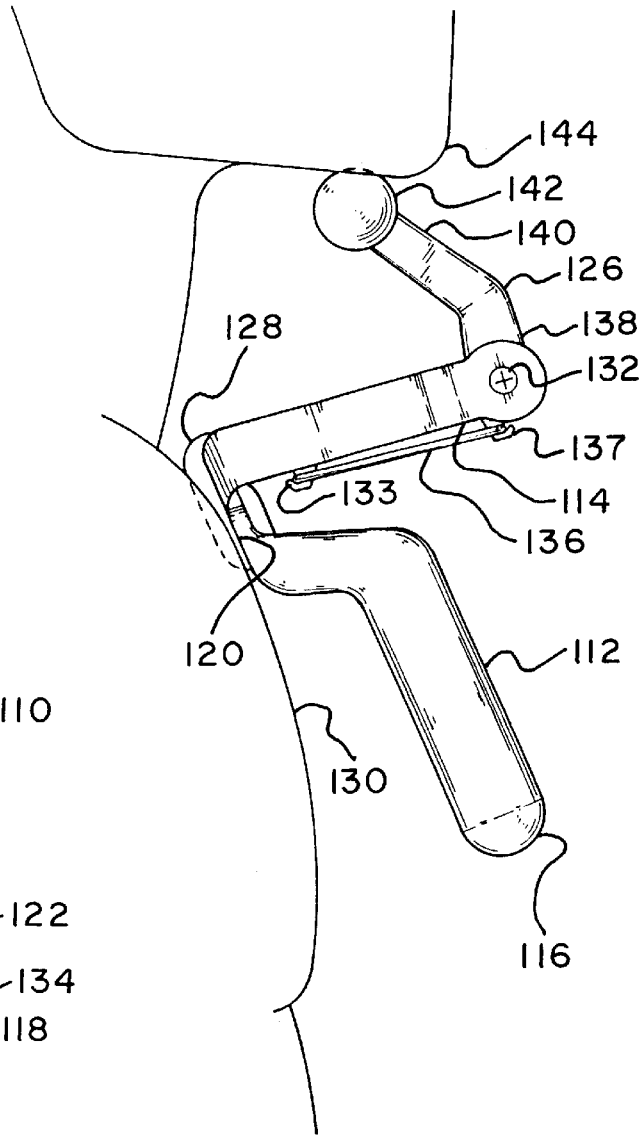
FIG. 4 is a schematic representation of a person using the second embodiment of the present invention.
Figure 3:
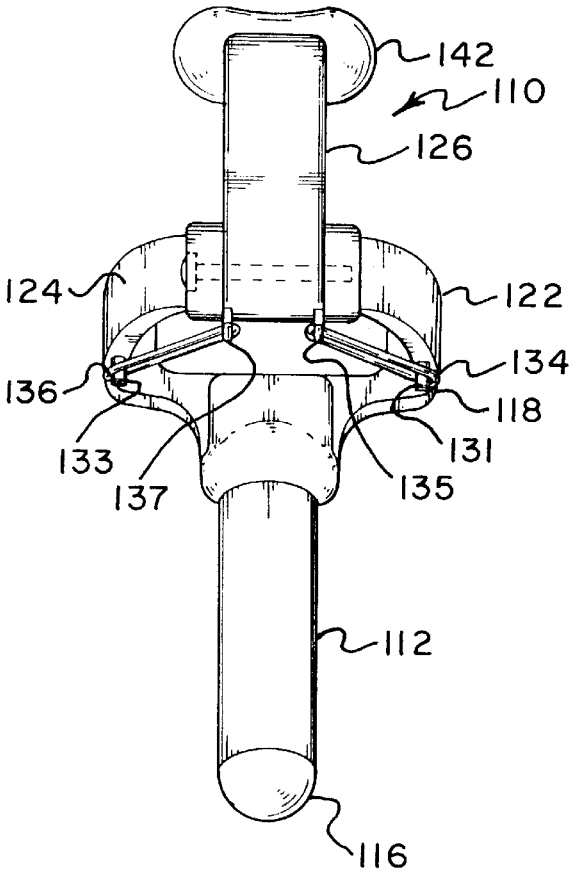
FIG. 3 is a front perspective view of a second embodiment of the present invention.

The second embodiment of the chin exercise device 110 of the present invention is illustrated in FIGS. 3 and 4 and also includes an elongated handle 112 having a top end or extension 114, a bottom end 116, a front side 118, and a rear side 120; a pair of curved members 122 and 124 extending outwardly from the top end 114 of the handle 112; and an arm 126 which is pivotally mounted to the curved members 122 and 124. Attached to the rear side 120 of the elongated handle 112 is means 128 for resting the handle on a person's clavicle or chest 130. (See FIG. 4.) Resting means 128 may include a foam pad which is placed against a person's clavicle or chest 130 when the device is used by a person to exercise.

Arm 126 is pivotably attached to curved members 122 and 124 by pivot member 132, such as a pin. Elastic bands 134 and 136 are secured to hooks 131 and 133 on the curved members 122 and 124, respectively, and hooks 135 and 137 on the first end 138 of arm 126. Any type of elastic band typically used in exercise devices may be used, for example, rubber bands may be used. Located at a second end 140 of the arm 126 is means 142 for receiving a person's chin. Means 142 includes a foam pad or the like into which a person places his or her chin 144 while exercising.

In order to use the device a person holds the handle 112 and places means 128 against his or her chest 130. The person then places his or her chin 144 into or on the foam pad 142 on the arm 126. The person moves his or her chin 144 downwardly, toward his or her chest 130. The rubber bands 134 and 136 create resistance as the person brings his or her chin 144 down, thereby exercising the muscles of the chin. The thickness, size, and/or number of rubber bands may be varied in order to increase or decrease the resistance.

Figure 5:
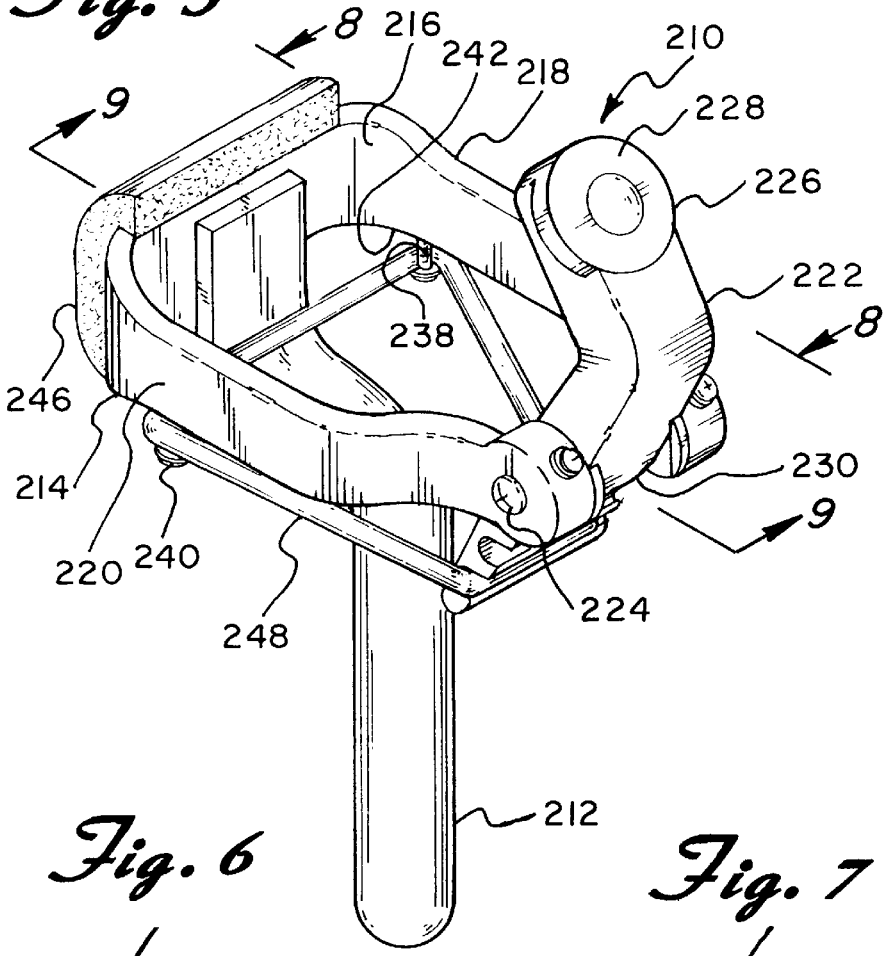
FIG. 5 is a perspective view of the third embodiment of the present invention.
Figure 6:
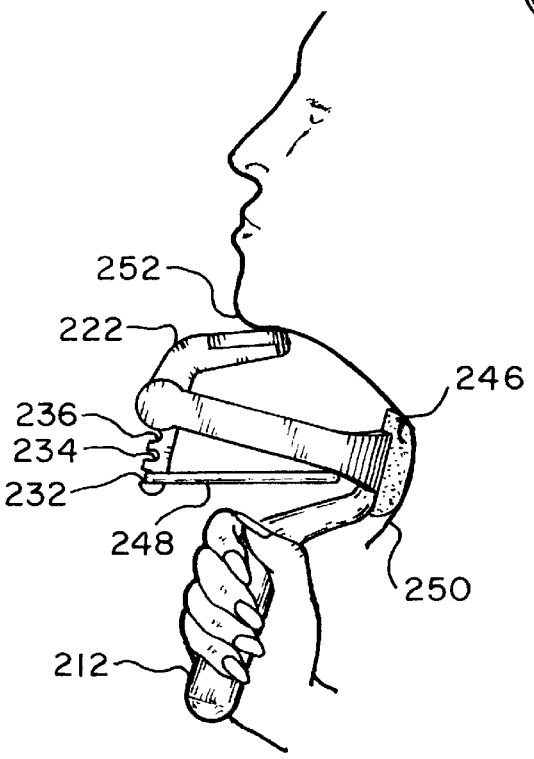
FIG. 6 is a schematic representation of a person using the third embodiment of the present invention with the device in an initial position.
Figure 7:
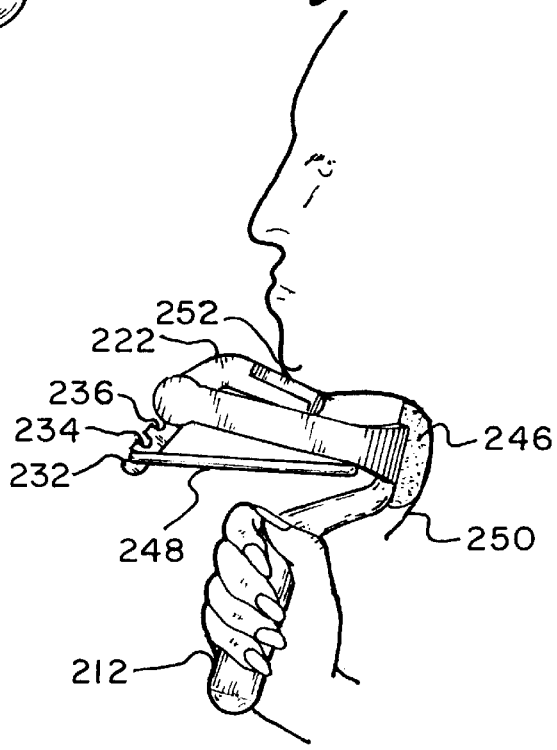
FIG. 7 is a schematic representation of a person using the third embodiment of the present invention with the device in a compressed position.
Figure 8:
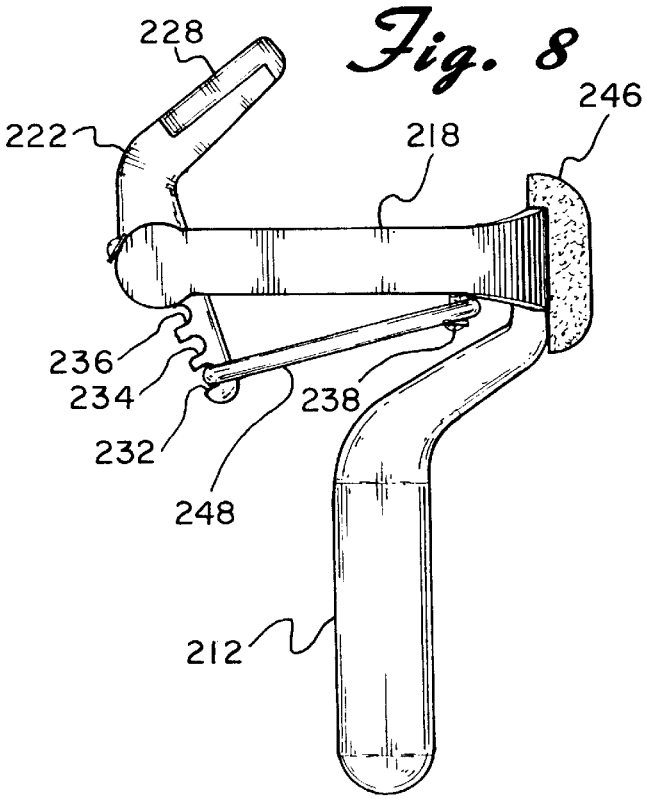
FIG. 8 is a side view of the third embodiment taken along line 8—8 of FIG. 5.
Figure 9:
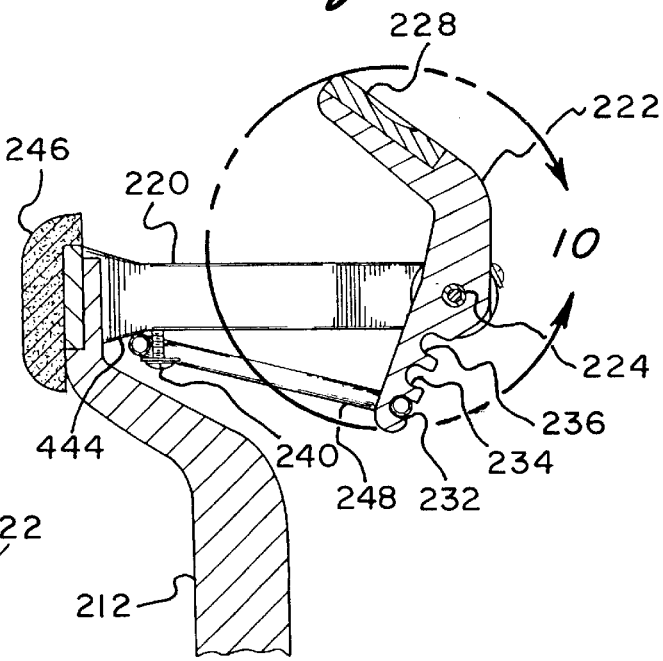
FIG. 9 is a partial cross-sectional view of the third embodiment taken along line 9—9 of FIG. 5.
Figure 10:
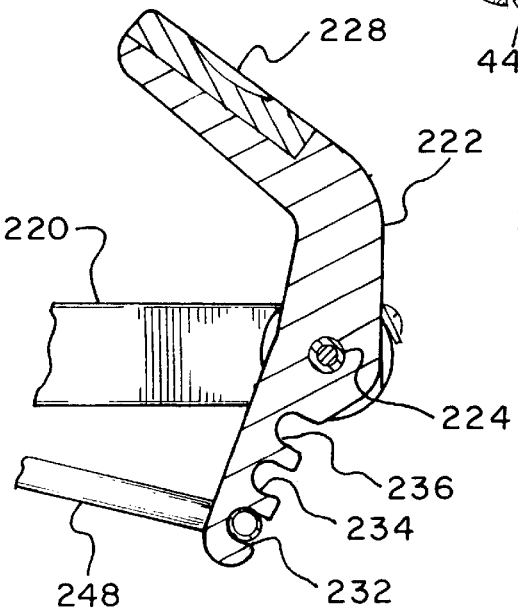
FIG. 10 is a partial, enlarged view of the third embodiment taken along line 10 of FIG. 9.
Figure 11:
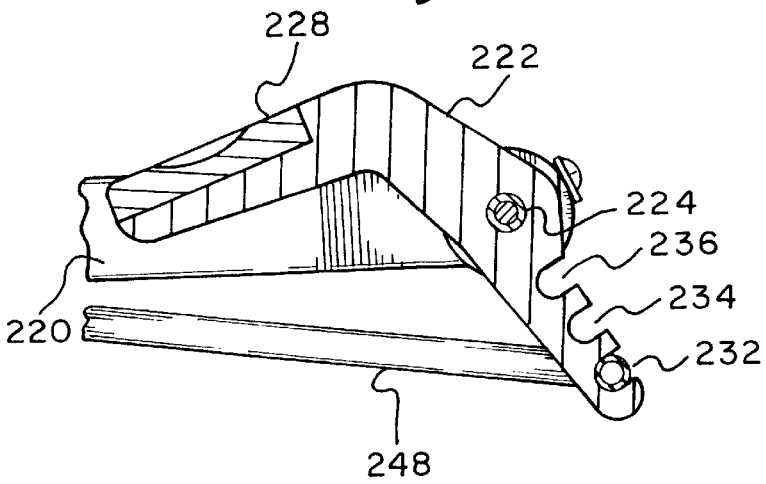
FIG. 11 is a partial cross-sectional view of the third embodiment with the elastic band shown in the first grooved section.
Figure 12:
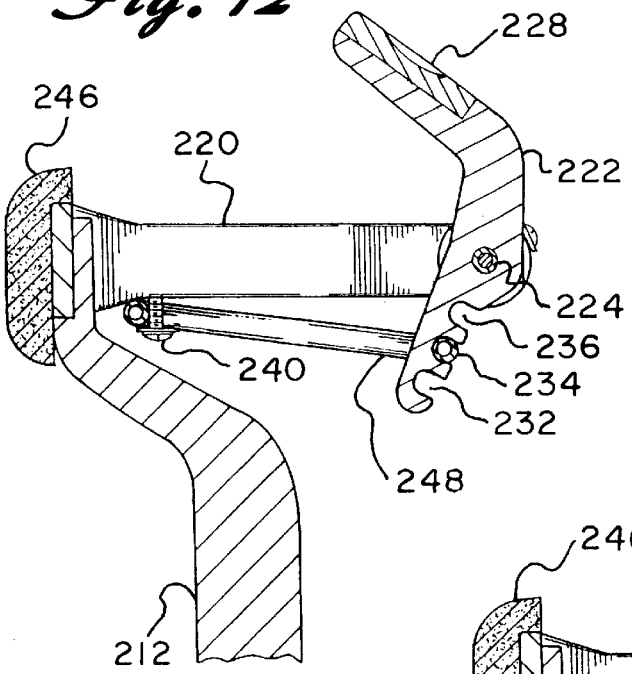
FIG. 12 is a partial cross-sectional view of the third embodiment with the elastic band shown in the second grooved section.
Figure 13:
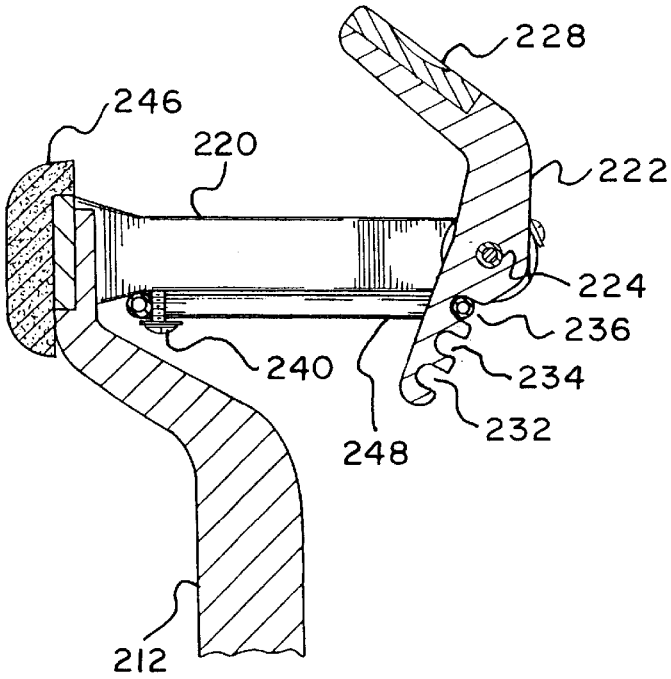
FIG. 13 is a partial cross-sectional view of the third embodiment with the elastic band shown in the third grooved section.

The third embodiment of the present invention differs from the first two embodiments in that the chin exercise device 210 uses a single band and the placement of the band may be varied. (See FIGS. 5–13.) This embodiment includes an elongated handle 212. Attached to the handle 212 is a U-shaped member 214 with a base member 216 and two extensions 218 and 220 extending outwardly from the base member 216. The handle 212 is attached to the base member 216. Pivotally attached to the ends of the extensions 218 and 220 and extending between the extensions is arm 222 via pin 224. At a first or top end 226 of the arm 222 is means 228 for receiving a person's chin. Means 228 may be a foam pad or the like. Near a second or bottom end 230 of the arm 222 are several grooved or indented sections or notches 232, 234, and 236. The number of sections may vary; however, the figures illustrate three grooved sections. Extending downwardly from the base member 216 are connecting means 238 and 240, which may be screws, at ends 242 and 244, respectively, of the base member 216. (See FIGS. 5 and 9.) Also attached to the base member 216 is means 246 for resting a person's clavicle or chest. Means 246 may include a foam pad or the like.

An elastic band 248 is placed around the screw members 238 and 240 and is held in one of the grooved sections depending upon the amount of resistance desired by the user. (See FIGS. 11–13.) The size and thickness of the band may be varied. The band may be made from rubber or any other elastic material generally used in the art.

In order to use the device a person holds the handle 212 and places means 246 against his or her clavicle or chest 250. The person places his or her chin 252 into or on the foam pad 228 on the arm 222. (See FIG. 6.) The person then moves his or her chin 252 downwardly, toward his or her chest 250. (See FIG. 7.) The elastic band 248 creates resistance as the person brings his or her chin 252 down, thereby exercising the muscles of the chin. The position of the band may be varied, depending upon the amount of resistance desired by the user. (See FIGS. 11–13.) The present invention may be embodied in other specific forms without departing from the spirit or essential attributes thereof and accordingly, reference should be made to the appended claims rather than to the foregoing specification as indicating the scope of the invention.

I claim:

1. A chin exercise device comprising:

an elongated handle;

an arm pivotally mounted to said handle;

means attached to said arm for receiving a person's chin, said receiving means including a foam pad;

means for resting said handle against a person;

curved members extending from said handle and attached to said arm; and means attached to said arm for creating resistance, said means for creating resistance including springs attached to said curved members.

2. The chin exercise device of claim 1 wherein said resting means includes a foam pad.

3. The chin exercise device of claim 2 wherein said means for creating resistance includes an elastic band attached to said base member and held in said at least one grooved section.

4. The chin exercise device of claim 3 wherein said arm has several grooved sections.

5. A chin exercise device comprising:

an elongated handle;

an arm pivotally mounted to said handle;

means attached to said arm for receiving a person's chin, said receiving means including a foam pad;

means for resting said handle against a person;

curved members extending from said handle and attached to said arm; and means attached to said arm for creating resistance, said means for creating resistance including at least one elastic band attached to said curved members and said arm.

6. A chin exercise device comprising:

an elongated handle;

an arm pivotally mounted to said handle;

means attached to said arm for receiving a person's chin;

means for resting said handle against a person;

means attached to said arm for creating resistance; and a base member with at least one outwardly extending extension wherein said arm is pivotally attached to said at least one extension.

7. The chin exercise device of claim 6 wherein said arm has at least one grooved section.

* * * * *